US007934282B2

(12) United States Patent
Cho et al.

(10) Patent No.: US 7,934,282 B2
(45) Date of Patent: May 3, 2011

(54) METHOD FOR CLEANING A TUB IN A WASHING MACHINE AND A WASHING MACHINE PERFORMING THE SAME

(75) Inventors: Han Ki Cho, Changwon-si (KR); Jong Min Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 254 days.

(21) Appl. No.: 11/628,753

(22) PCT Filed: Dec. 22, 2005

(86) PCT No.: PCT/KR2005/004480

§ 371 (c)(1), (2), (4) Date: Oct. 20, 2008

(87) PCT Pub. No.: WO2007/073013

PCT Pub. Date: Jun. 28, 2007

(65) Prior Publication Data

US 2009/0050178 A1 Feb. 26, 2009

(51) Int. Cl.
*D06F 39/08* (2006.01)

(52) U.S. Cl. ..... 8/159; 68/12.02; 68/17 R; 68/207

(58) Field of Classification Search ..... 68/12.02, 68/207

See application file for complete search history.

(56) References Cited

U.S. PATENT DOCUMENTS

| | | | | |
|---|---|---|---|---|
| 2,062,668 | A * | 12/1936 | Krauss | 68/172 |
| 4,400,838 | A * | 8/1983 | Steers et al. | 8/158 |
| 6,463,766 | B2 * | 10/2002 | Kubota et al. | 68/12.18 |
| 7,171,714 | B2 * | 2/2007 | Pyo et al. | 8/159 |
| 7,585,374 | B2 * | 9/2009 | Sechelmann | 134/18 |
| 2006/0151005 | A1 * | 7/2006 | Kim et al. | 134/22.1 |

FOREIGN PATENT DOCUMENTS

| | | | |
|---|---|---|---|
| CN | 1490456 | | 4/2004 |
| CN | 1566497 | | 1/2005 |
| DE | 19751028 | A1 | 5/1999 |
| EP | 0808936 | A2 | 11/1997 |
| JP | 64-46499 | | 2/1989 |
| JP | 04-108494 | * | 4/1992 |
| JP | 6-238088 | | 8/1994 |
| JP | 10-127979 | | 5/1998 |
| JP | 10-221157 | * | 8/1998 |
| JP | 2002-018186 | * | 1/2001 |
| JP | 2002-102590 | * | 4/2002 |

(Continued)

*Primary Examiner* — Frankie L Stinson

(74) *Attorney, Agent, or Firm* — McKenna Long & Aldridge LLP

(57) ABSTRACT

The present invention relates to a method for washing a washing tub and a washing machine having the same applied thereto, and more particularly, a method for washing a washing tub including the step of washing a washing tub with powder detergent and a step for washing the washing tub with bleaching agent; and a washing machine having the same applied thereto. A method for cleaning a tub in a washing machine includes a washing water supply step for supplying washing water to the washing tub, a powder detergent supply step for supplying powder detergent to the washing tub, a powder detergent washing step for washing the washing tub with the powder detergent, a bleaching agent supply step for supplying bleaching agent to the washing tub, and a bleaching agent washing step for washing the washing tub with bleaching agent.

17 Claims, 5 Drawing Sheets

FOREIGN PATENT DOCUMENTS

| | | | |
|---|---|---|---|
| JP | 2003-000991 | * | 1/2003 |
| JP | 2003-096499 | * | 4/2003 |
| JP | 2003-144790 | * | 5/2003 |
| JP | 2004-141344 | * | 5/2004 |
| KR | 2001-010111 | * | 2/2001 |
| KR | 2003-045446 | * | 6/2003 |
| KR | 2004-046997 | * | 6/2004 |
| WO | WO 2005/001189 | | 1/2005 |

* cited by examiner

METHOD FOR CLEANING A TUB IN A WASHING MACHINE AND A WASHING MACHINE PERFORMING THE SAME

This application claims priority to International application No. PCT/KR2005/004480 filed on Dec. 22, 2005, which is incorporated by reference, as if fully set forth herein.

TECHNICAL FIELD

The present invention relates to a method for washing a washing tub and a washing machine having the same applied thereto, and more particularly, a method for washing a washing tub including the step of washing a washing tub with powder detergent and a step for washing the washing tub with bleaching agent; and a washing machine having the same applied thereto.

BACKGROUND ART

In general, the washing machine washes by using composite action of friction between water circulation and laundry caused by forced circulation of washing water, softening action of detergent, and impact applied to the laundry by a pulsator.

Referring to FIG. 1, such a related art washing machine is provided with a body 10 forming an exterior of the washing machine, an outer tub 20, a washing tub 30 also used as a spinning tub, a pulsator 40, and power transmission means for transmission of power from a motor to the washing tub 30 or the pulsator 40.

The outer tub 20 is suspended in the body, for holding washing water.

The washing tub 30 is rotatably mounted in the outer tub 20 with an appropriate space thereto, and has a plurality of pass through holes 31 for communication with an inside space of the outer tub 20.

The pulsator 40 is rotatably mounted on a center of an inside bottom of the washing tub 30.

The power transmission means is provided with a clutch 50 and a belt 70.

The clutch 50 is fixedly secured to an underside of the outer tub 20, and coupled to the pulsator 40 and the washing tub 30 with a shaft, for rotating the pulsator 40 or the washing tub 30, selectively.

The motor 60 is mounted on one side of an underside of the outer tub 20, for transmission of power to the clutch 50.

In the meantime, on one side of an upper side of the body 10, there is a water supply hose 12 connected thereto, and on one side of the underside of the outer tub 20, there is a drain hose 14 connected thereto for draining washing water.

On top of the body 10 of the washing machine, there is a display window (not shown) for displaying a washing course selected by the user, a washing progressing state, a time period, and the like.

In the washing machine, once a washing mode is selected in a state laundry and detergent is introduced in the washing tub 30, in general, washing, rinsing, and spinning are made automatically according to a control signal from a controller (not shown).

That is, once a washing mode is selected, a water supply valve 11 on the water supply hose is opened, to supply washing water to the washing tub 30 through the water supply hose 11. In this instance, the washing water may be supplied through a powder detergent box, to supply the powder detergent to the washing tub 30, together with the washing water.

In this instance, since the washing tub is in communication with the outer tub 20 through the plurality of pass through holes 31 in the outside circumferential surface, as described before, the washing water supplied to the washing tub 30 is introduced to the outer tub 20 through the pass through holes 31 in the washing tub 30, too.

If the washing water is filled in the outer tub 20 and the washing tub 30 to a certain level by the foregoing process, the water supply valve 11 is closed, to stop the water supply, and the motor 60 fixedly secured to one side of the underside of the outer tub 20 is driven, to drive the clutch, to rotate the washing tub 30 or the pulsator 40 selectively depending on washing cycle.

Accordingly, the laundry in the washing tub 30 is washed by rotation force of the pulsator 40, friction force with an inside circumference of the washing tub 30, and a separative power of the detergent.

Then, when the washing cycle is finished by above actions, the drain valve 13 on the drain hose 14 is opened in response to a control signal from the controller (not shown), the washing water used for the washing is drained from the outer tub 20 and the washing tub 30 to an outside of the body 10 through the drain hose 14.

Thereafter, a rinsing cycle is performed, in which rinsing is repeated a few times in a state washing water is supplied to the washing tub 30. In this instance, since the washing water may be supplied through a bleaching agent box, the bleaching agent may be supplied to the washing tub 30, together with the washing water.

In this instance, the washing machine may also be controlled such that, following draining, short time period of spinning and re-supply of new washing water may be made between rinsing cycles, for improving rinsing efficiency.

Moreover, after such a rinsing cycle is finished fully, a final spinning is performed, when the washing tub 30 and the pulsator 40 are rotated at a high speed in a state the washing water used in the rinsing is naturally drained to an outside of the washing machine.

According to this, water is extracted from the laundry to the outer tub 20 through the pass through holes 31 in the washing tub 30 by centrifugal force caused by the high speed rotation of the washing tub 30 and the pulsator 40.

Moreover, in this instance, since the drain valve 13 under the outer tub 20 is opened, the water from the laundry is drained to an outside of the washing machine through the drain hose 14.

Above spinning cycle is performed for a preset time period, and once the spinning cycle is finished, operation of the washing machine is stopped fully, to finish the washing course.

In the meantime, other than above type and structure of washing machine, there are a so called a tub rotating type of washing machine in which the washing tub 30 rotates in a direction opposite to a rotation direction of the pulsator, and a centrifugal penetration type of washing machine in which the washing is made by water penetrating through the laundry by centrifugal force generated by high speed rotation of the washing machine directly connected to a motor.

Moreover, though not shown, the related art washing machine may be provided with a device for supplying steam to the washing tub for enhancing an washing effect. By supplying hot steam to the laundry, the washing effect is enhanced.

However, regardless of the washing types and structures of above washing machines, there has been a problem in the related art in that dirt from the laundry during washing, and remains and mixtures of detergent and softener remain on inside/outside walls of the washing tub 30, and on an inside wall of the outer tub, to cause re-contamination of the laundry, to drop reliability of the washing machine in view of sanitary.

Moreover, bad odor is produced from microbes, such as fungus on the dirt when the tub is contaminated, to drop reliability of the washing machine in view of sanitary, too.

In general, as the washing machine is used for a long time period, dirt accumulates on the inside/outside surfaces of the washing tub 30 and the inside surface of the outer tub, to increase an amount as time goes by.

In the meantime, though there are washing machines having tub washing functions for resolving problems started from the tub contamination, the present washing machines having the tub washing functions have a poor tub washing efficiency as the tub washing course is progressed ineffectively.

Related art tub washing methods have failed to wash the tub with the powder detergent, resulting to fail to obtain a washing effect of the power detergent. The failure of washing of the tub with the powder detergent have caused the failure of clean washing of the washing tub. Though there are many kinds of contaminants from the laundry which can be washed by the power detergent more effectively, the failure of washing the tub with the power detergent in the related art causes the failure of obtaining such an effect.

Moreover, the failure of cleaning the washing tub causes a problem of requiring a longer or frequent washing of the washing tub.

DISCLOSURE

Technical Problem

An object of the present invention is to solve problems in the related art.

Another object of the present invention is to solve the problem of failing clean washing of the washing tub due to washing without powder detergent.

Another object of the present invention is to solve the problem of the long time or frequent ineffective washing of the washing tub.

Technical Solution

The object of the present invention can be achieved by providing a method for cleaning a tub in a washing machine including a washing water supply step for supplying washing water to the washing tub, a powder detergent supply step for supplying powder detergent to the washing tub, a powder detergent washing step for washing the washing tub with the powder detergent, a bleaching agent supply step for supplying bleaching agent to the washing tub, and a bleaching agent washing step for washing the washing tub with bleaching agent.

The method may further includes the step of draining after washing with the powder detergent between the powder detergent washing step and the bleaching agent supply step, for draining washing water from the washing tub, and the step of supplying washing water after the washing with the powder detergent after the powder detergent washing step, for supplying washing water to the washing tub.

Preferably, the washing water supply step includes the step of supplying washing water through a powder box, for making the washing water supply step and the powder detergent supply step at the same time.

Preferably, the step of supplying washing water after the washing with the powder detergent includes the step of supplying washing water through a bleaching agent box, for making the step of supplying washing water after the washing with the powder detergent and the bleaching agent supply step at the same time.

The method may further includes a laundry amount sensing step for sensing a laundry amount in the washing tub, for determining to proceed to the next step. The laundry amount sensing may be made with, or without the washing water in the washing tub.

It is preferable that the method proceeds to the next step if it is known that there is no laundry in the washing tub in the laundry amount sensing step. Because the laundry in the washing tub causes unbalance to generate noise and vibration.

The laundry amount sensing step may include the step of using RPM ripple of a motor which rotates the washing tub when the washing tub is rotated at a constant speed, for sensing a laundry amount.

The laundry amount sensing may be made by sensing a water level change of the washing water in the washing tub. The water level in the washing tub changes as the laundry is wet with the water if there is laundry in the washing tub, using which existence of the water can be known. Such a water level change can be known by using, for an example, a flow meter.

The powder detergent washing step includes the step of rotating the washing tub at a low speed. The washing machine is rotated at a low speed for preventing foam from forming unnecessarily. The foam impedes rotation of the washing tub, to cause a power loss of the motor that rotates the washing tub.

Moreover, the powder detergent washing step further includes the step of rotating the washing tub in a clockwise direction and a counter clockwise direction, alternately. One direction rotation of the washing tub forms a fixed form of circulation that causes a portion of a surface of the washing tub to which the washing water does not reach, resulting to drop a washing effect poorer than a case the washing water circulates irregularly.

The bleaching agent washing step includes the step of rotating the washing tub at a high speed. Different from the powder detergent, the bleaching agent forms no foam.

The high speed rotation of the washing tub in the bleaching agent washing step, leading to form a strong circulation, is effective for washing, and can provide a better washing effect as the bleaching agent passes through the pass through holes in the washing tub by centrifugal force together with the washing water.

The bleaching agent washing step may further include the step of rotating the washing tub in a clockwise direction and a counter clockwise direction, alternately.

The method further includes the soaking step for soaking dirt by making the washing water to be brought into contact with the dirt on surface of the washing tub while making the washing tub to move.

The soaking step may include a steam supply step for supplying steam to the washing tub. The steam supplied thus causes effective soaking of the dirt on the surface of the washing tub. The steam itself has an effect to make the soaking more active than water. Moreover, different from the water, since the steam, a gas, diffuses throughout the washing tub uniformly, the steam can soak even portions of the washing tub to which the water can not reach.

The method may further includes, after the bleaching agent washing step, a draining step for draining water from the washing tub, a rinsing step for rinsing the washing tub, and a spinning step for spinning the washing tub at a high speed after the rinsing step for extracting water.

The rinsing step may be performed together with the draining step.

The rinsing step may include a step for supplying water for rinsing the washing tub, and draining the water.

In the meantime, the washing machine of the present invention includes a controller having the foregoing washing tub cleaning method programmed therein. Therefore, if the user selects a washing tub washing course with a button on the control panel, the controller controls the washing machine to perform the applied washing course.

The washing machine of the present invention is characterized in that above washing tub cleaning method is programmed in a controller, of which detailed description will be omitted since the washing tub cleaning method disclosed as above can be embodied by person skilled in the field of art.

Above steps of the present invention have no specific limitation, and the context may change as far as the change is not contradictory to the object of the present invention, or in cases, may be performed at the same time. For an example, though the soaking step may be performed after the washing waster supply step, the washing water supply step may be progressed partly, to supply a portion of the washing water, and after the soaking step is performed, the washing water supply step may be performed again. Or, the washing water supply step and the soaking step may be performed at the same time.

Advantageous Effects

The present invention solves the problems of the related art described before.

Because the washing tub is washed, not only with bleaching agent, but also with power detergent, the washing is clean.

A total time period required for washing the washing tub can be reduced, and even if the washing tub is not washed frequently, the washing tub can be kept clean.

BEST MODE

Figure 1:
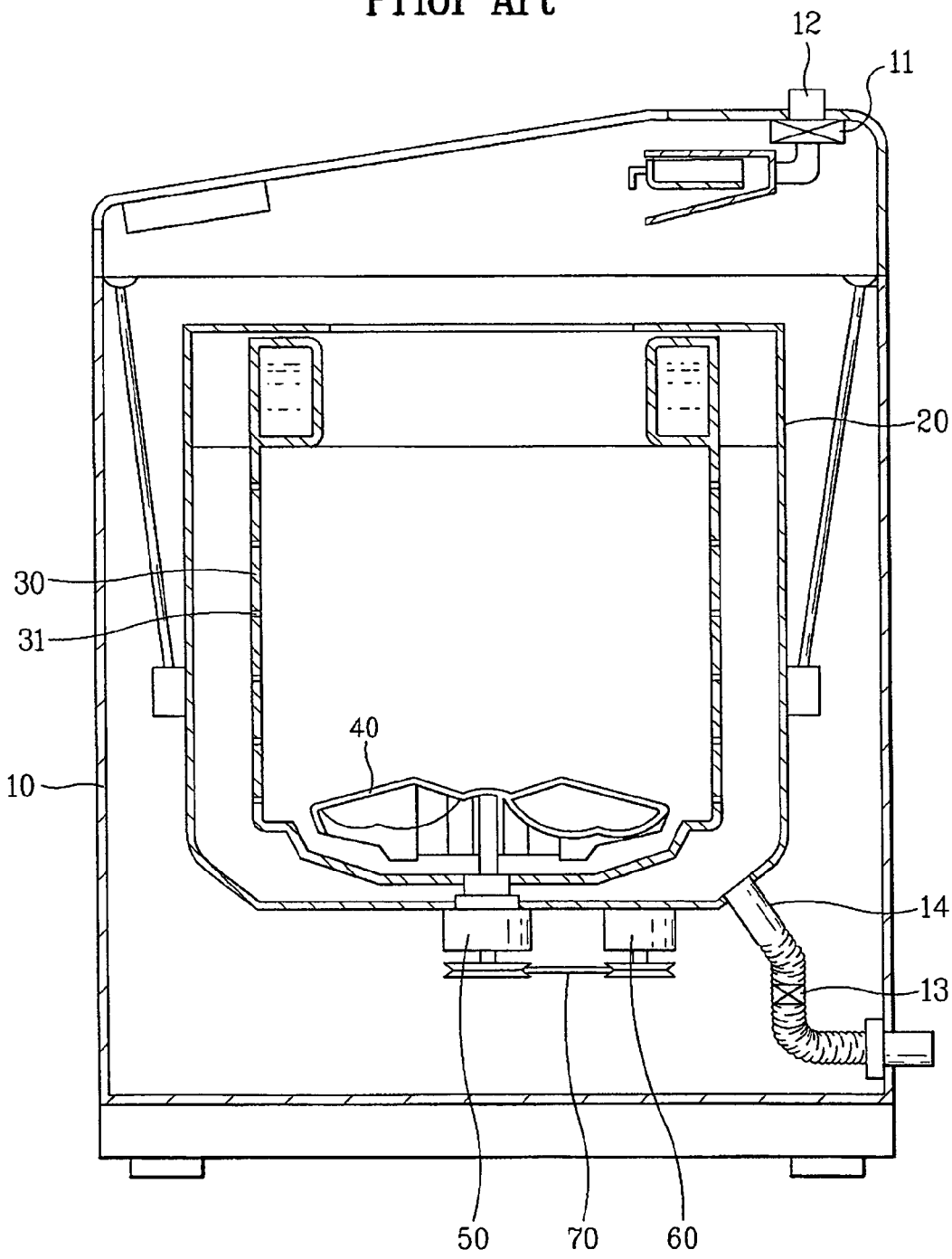
FIG. 1 Prior Art
FIG. 1 illustrates a related art washing machine.
Figure 2:
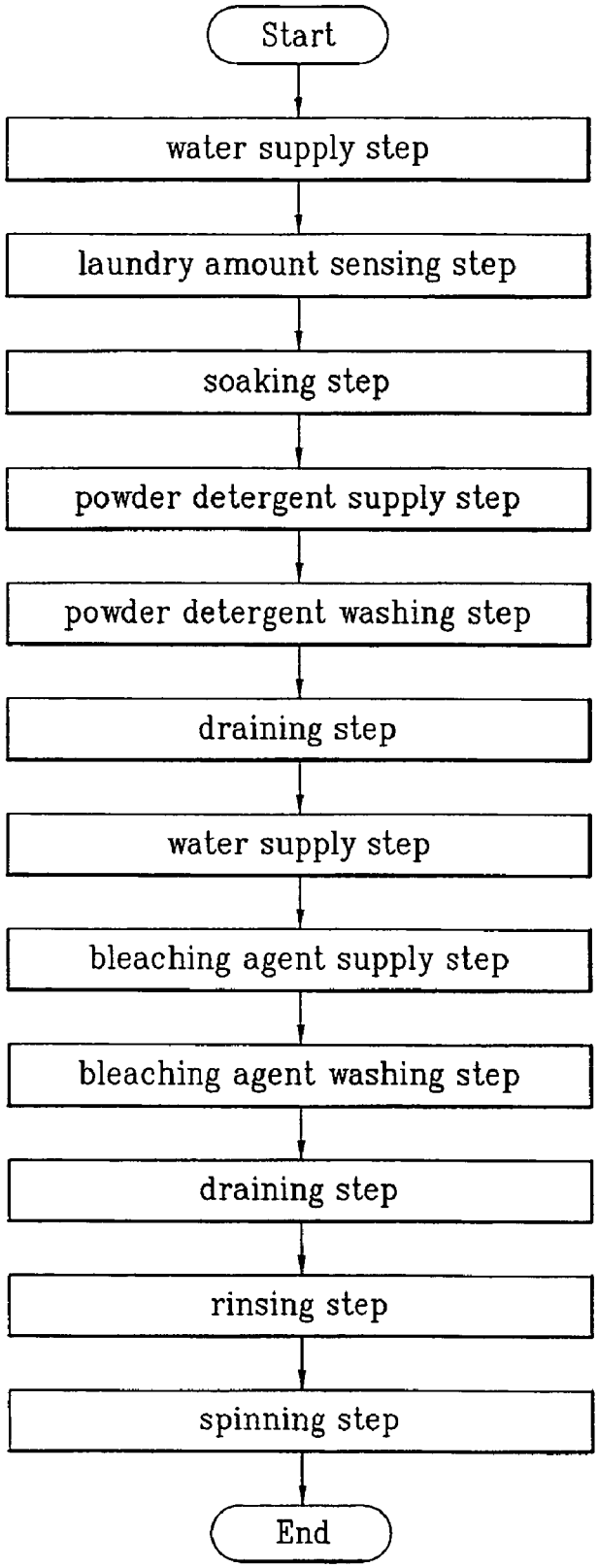
FIG. 2 illustrates a flow chart showing the steps of a method for washing a washing tub in accordance with a preferred embodiment of the present invention.

FIG. 2 illustrates a flow chart showing the steps of a method for washing a washing tub in accordance with a preferred embodiment of the present invention, including a washing water supply step, a laundry amount sensing step, a soaking step, a powder detergent supply step, a powder detergent washing step, a washing water draining step of, a washing water supply step, a bleaching agent supply step, a bleaching agent washing step, a washing water draining step, a rinsing step, and a spinning step.

In the washing water supply step, washing water required for the washing of the washing tub is supplied to the washing tub.

Then, the laundry amount sensing step is performed for sensing a laundry amount in the washing tub to determine whether to proceed to the next step of not in a state required washing water is supplied partly, or fully. In a case the washing water is supplied only partly in the washing water supply step, rest of the washing water is supplied after the laundry amount sensing step is finished, to finish the washing water supply step.

Figure 4:
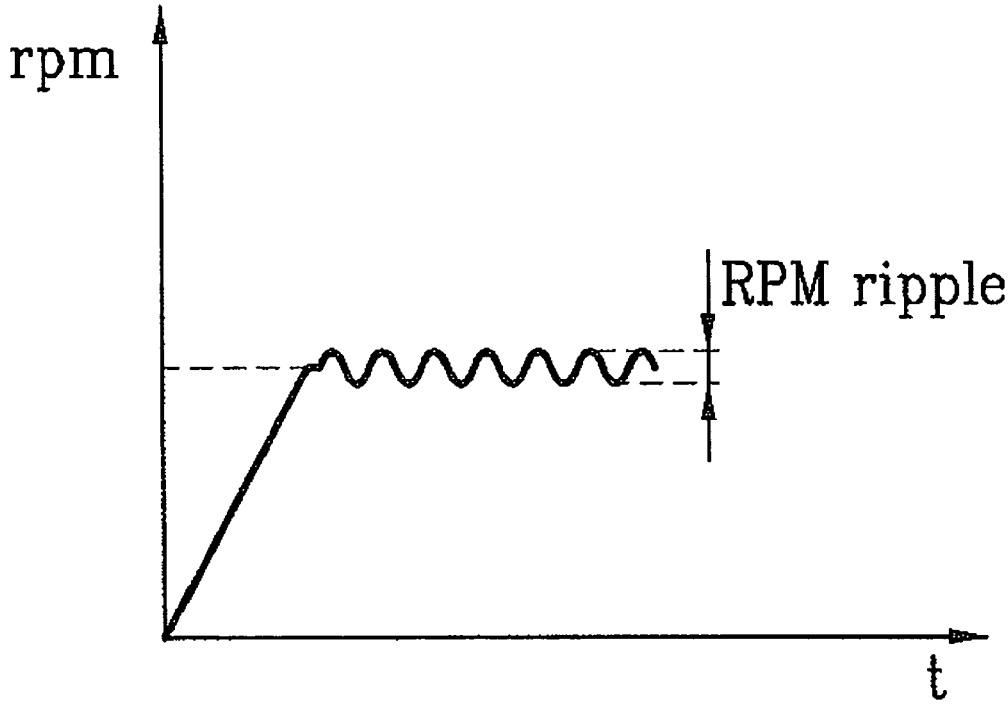
FIG. 4 illustrates a graph showing RPM of a motor at the time of constant speed rotation of a washing tub.

FIG. 4 illustrates a graph showing RPM of a motor at the time of constant speed rotation of a washing tub. Laundry in the washing tub causes unbalance to vary RPM of the motor, utilizing which existence of laundry in the washing tub can be detected.

Referring to FIG. 4, if the washing tub is controlled to be rotated at a constant speed, RPM of the motor ripples. The laundry amount is sensed by using the RPM ripple.

Figure 5:
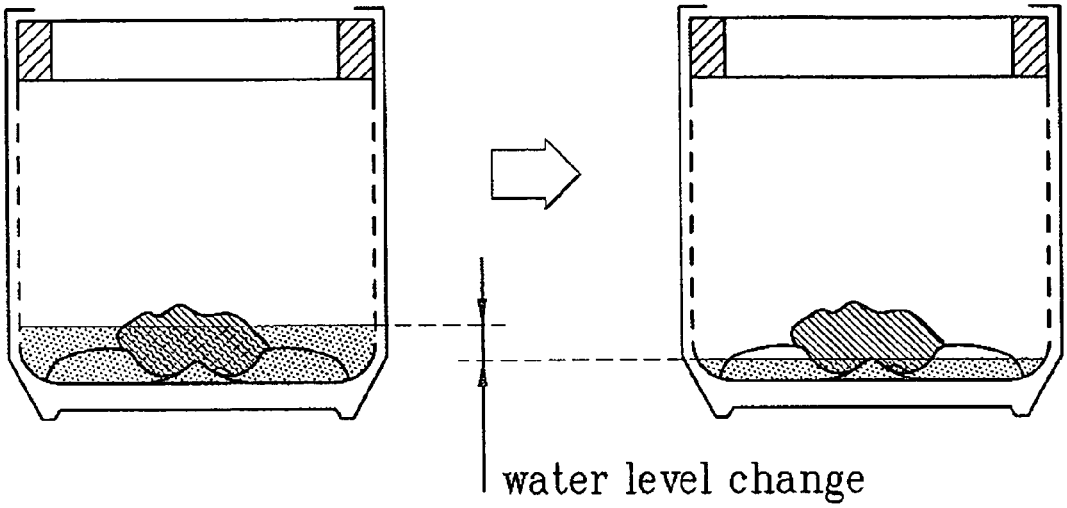
FIG. 5 illustrates a water level change when laundry is in a washing tub.

FIG. 5 illustrates a water level change when laundry is in a washing tub. The laundry in the washing tub absorbs water, to change the water level in the washing tub, by using which the laundry amount can be sensed. The water level change can be sensed by using a flow meter.

It is preferable that the laundry amount sensing step is performed at an early stage as far as possible once the user selects a washing course of the washing tub. For an example, the laundry amount sensing step may be performed before the water supply step.

If it is known that there is no laundry in the washing tub in the laundry amount sensing step, the method proceeds to the soaking step. The soaking step requires an appropriate time period for the water to penetrate into the dirt on a surface of the washing tub.

Figure 3:
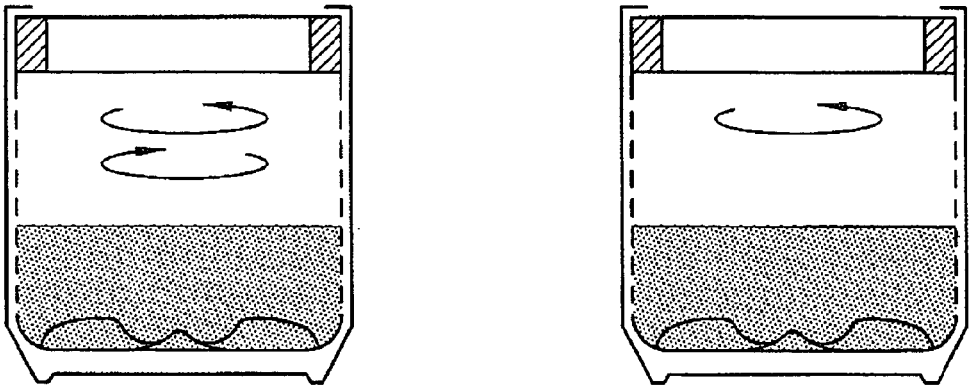
FIG. 3 illustrates forms of rotation of the washing tub.

Referring to FIG. 3, in the soaking step, the washing tub may rotate alternately, or only in one direction, or compositely in which the alternate rotation and one directional rotate take place in a combination. The rotation of washing tub makes the washing water to circulate to apply the washing water to the surface of the washing tub, uniformly. Preferably, the washing tub rotates in a clockwise direction for 10 seconds, pauses for 20 seconds, and rotates in a counter clockwise direction for 10 seconds. In the soaking step, the rotation speed of the washing tub is required to be high not necessarily, but to make the washing water to reach to an upper surface of the washing tub.

Upon finishing the step of rotating the washing tub to circulate the washing water, the stem supply step is performed, in which steam is supplied to the washing tub. It is preferable that a certain time period is waited after steam is supplied, until water or steam penetrates into dirt, to make the soaking action, well.

When the soaking is finished, the powder detergent supply step is performed, in which the powder detergent is supplied to the washing tub for washing the washing tub with the powder detergent.

Referring to FIG. 3, in the powder detergent washing step, the washing tub may rotate alternately in the clockwise direction and the counter clockwise direction, or only in one direction, or compositely in which the alternate rotation and one directional rotate take place in a combination. It is preferable that the washing tub is rotated at a low speed, because high speed rotation of the washing tub is likely to produce much foam from the powder detergent.

When the powder detergent washing step is finished, the draining step is performed, in which the washing water is drained from the washing tub, and preferably, the rinsing step is added after the draining step. In the rinsing step, the powder detergent is washed from the washing tub. If the washing tub rotates at a high speed in the bleaching agent washing step, the powder detergent, if any, is likely to produce foam, to cause a loss of power.

When the draining is finished, the bleaching powder washing step is performed, in which washing water and bleaching agent is supplied to the washing tub for washing the washing tub with the bleaching agent.

In the bleaching agent washing step, the washing tub is rotated at a high speed for forming a strong water circulation, to make an effective washing action.

If the washing tub rotates at the high speed, the washing water spouts from the washing tub through the pass through holes by centrifugal force, making the washing water circulate quickly, thereby washing the washing tub, more effectively.

In the bleaching agent washing step of the embodiment, the washing tub rotates in the clockwise direction for 120 seconds, pauses for about 20 seconds, and rotates again in the counter clockwise direction for about 120 seconds. Above steps are repeated for a few times.

As the bleaching agent, for an example, an oxygen group of bleaching agent, or a chlorine group of bleaching agent may be used. Because the chlorine group of bleaching agent is liable to corrode the washing tub if the chlorine group of bleaching agent is used, it is required to pay attention so that there is no occasion in which the washing tub washing course is failed to be progressed normally, but is left abandoned for a long time in a state the chlorine group of bleaching agent is introduced in the washing tub.

Moreover, bactericidal agent, or anti-fungal agent may be introduced together with the bleaching agent, and as the bactericidal agent, halogenated hydantoin may be used mostly, which emits hypohalogen acid.

If the bleaching agent washing step is finished, the draining step is performed, in which the washing water is drained from the washing tub.

After the draining step, the rinsing step is performed, in which the washing tub is rinsed, and drained while the washing water is supplied. The draining step and the rinsing step may be made at the same time.

If the rinsing step is finished, the spinning step is performed, in which the washing tub is rotated at a high speed for removing water from the washing tub.

In the meantime, the washing machine having the method for washing a washing tub applied thereto in accordance with a preferred embodiment of the present invention includes the method programmed at the controller as a washing tub washing course. Accordingly, if the user selects the washing tub washing course with a button on a control panel, the method for washing a washing tub in FIG. 2 is performed, automatically.

Because the method for washing a washing tub in FIG. 2 is described, and embodying the washing machine by programming the method in FIG. 2 at the controller is easy to a person skilled in the field, no more detailed description will be given.

INDUSTRIAL APPLICABILITY

The present invention relates to a method for washing a washing tub and a washing machine having the same applied thereto, and more particularly, a method for washing a washing tub including the step of washing a washing tub with powder detergent and a step for washing the washing tub with bleaching agent; and a washing machine having the same applied thereto.

The washing of the washing tub, not only with bleaching agent, but also with powder detergent enables clean washing of the tub. Moreover, a total time period required for the washing of the washing tub can be reduced, and the washing tub can be kept clean even if the washing tub is not washed, frequently.

The invention claimed is:

1. A method for cleaning a tub in a washing machine comprising:

a washing water supply step for supplying washing water to the washing tub;

a powder detergent supply step for supplying powder detergent to the washing tub;

a powder detergent washing step for washing the washing tub with the powder detergent;

a bleaching agent supply step for supplying bleaching agent to the washing tub;

a bleaching agent washing step for washing the washing tub with bleaching agent;

a step of draining after washing with the powder detergent, between the powder detergent washing step and the bleaching agent supply step, for draining washing water from the washing tub; and a step of supplying washing water, after the powder detergent washing step, for supplying washing water to the washing tub.

2. The method as claimed in claim 1, wherein the washing water supply step includes a step of supplying washing water through a powder box, for making the washing water supply step and the powder detergent supply step at the same time.

3. The method as claimed in claim 1, wherein the step of supplying washing water after the washing with the powder detergent includes a step of supplying washing water through a bleaching agent box, for making the step of supplying washing water after the washing with the powder detergent and the bleaching agent supply step at the same time.

4. The method as claimed in claim 1, further comprising a laundry amount sensing step for sensing a laundry amount in the washing tub and determining to proceed to the next step.

5. The method as claimed in claim 4, wherein the laundry amount sensing step includes a step of using RPM ripple of a motor which rotates the washing tub when the washing tub is rotated at a constant speed, for sensing a laundry amount.

6. The method as claimed in claim 4, wherein the laundry amount sensing step includes a step of sensing a water level change of the washing water in the washing tub in a state the washing tub is stopped, for sensing a laundry amount.

7. The method as claimed in claim 1, wherein the powder detergent washing step includes a step of rotating the washing tub at a low speed.

8. The method as claimed in claim 1, wherein the powder detergent washing step further includes a step of rotating the washing tub in a clockwise direction and a counter clockwise direction, alternately.

9. The method as claimed in claim 1, wherein the bleaching agent washing step includes a step of rotating the washing tub at a high speed.

10. The method as claimed in claim 1, wherein the bleaching agent washing step further includes a step of rotating the washing tub in a clockwise direction and a counter clockwise direction, alternately.

11. The method as claimed in claim 10, wherein the bleaching agent washing step further includes a step of rotating the washing tub at a high speed.

12. The method as claimed in claim 1, further comprising a soaking step for soaking dirt by making the washing water to be brought into contact with the dirt on surface of the washing tub while making the washing tub to move.

13. The method as claimed in claim 12, wherein the soaking step includes a steam supply step for supplying steam to the washing tub.

14. The method as claimed in claim 1, the method, after the bleaching agent washing step, further comprising:

a draining step for draining water from the washing tub;

a rinsing step for rinsing the washing tub; and a spinning step for spinning the washing tub at a high speed after the rinsing step for extracting water.

15. A washing machine having a washing tub washing course comprising:

a washing tub;

a driving unit for rotating the washing tub;

a control panel having washing tub washing course selection means for enabling to select a preset washing tub washing course; and a controller for performing the washing tub washing course following selection of the washing tub washing course at the control panel, wherein the washing tub washing course includes:

a washing water supply step for supplying washing water to the washing tub, a powder detergent supply step for supplying powder detergent to the washing tub, a powder detergent washing step for washing the washing tub with the powder detergent, a bleaching agent supply step for supplying bleaching agent to the washing tub, a bleaching agent washing step for washing the washing tub with bleaching agent, a step of draining after washing with the powder detergent, between the powder detergent washing step and the bleaching agent supply step, for draining washing water from the washing tub, and a step of supplying washing water, after the powder detergent washing step, for supplying washing water to the washing tub.

16. The washing machine as claimed in claim 15, further comprising:

a powder box for holding powder detergent; and a bleaching agent box for holding bleaching agent; and the washing water supply step includes a step of supplying washing water through a powder box, for making the washing water supply step and the powder detergent supply step at the same time.

17. The washing machine as claimed in claim 15, further comprising:

a powder box for holding powder detergent; and a bleaching agent box for holding bleaching agent; and the step of supplying washing water after the washing with the powder detergent includes a step of supplying washing water through a bleaching agent box, for making the step of supplying washing water after the washing with the powder detergent and the bleaching agent supply step at the same time.

* * * * *